United States Patent [19]

Mattei et al.

[11] Patent Number: 4,745,932

[45] Date of Patent: May 24, 1988

[54] FILTER ASSEMBLY MACHINE

[75] Inventors: Riccardo Mattei; Alberto Manservigi, both of Bologna, Italy

[73] Assignee: G.D. Societá per Azioni, Bologna, Italy

[21] Appl. No.: 882,683

[22] Filed: Jul. 7, 1986

[30] Foreign Application Priority Data

Jul. 10, 1985 [IT] Italy ..... 3493 A/85
Sep. 11, 1985 [IT] Italy ..... 3542 A/85

[51] Int. Cl.[4] ..... A24C 5/47; A24C 5/58
[52] U.S. Cl. ..... 131/94; 131/95
[58] Field of Search ..... 131/94, 95

[56] References Cited

U.S. PATENT DOCUMENTS 4,003,386 1/1977 Bald et al. ..... 131/94
4,445,519 5/1984 Hinz et al. ..... 131/94
4,596,257 6/1986 Garthaffner et al. ..... 131/94

*Primary Examiner*—V. Millin
*Attorney, Agent, or Firm*—Marshall, O'Toole, Gerstein, Murray & Bicknell

[57] ABSTRACT

A filter assembly machine having an input roller with spaced peripheral seats for cigarette groups, each group being two coaxial cigarettes with a double filter therebetween; and a rolling unit for said groups; the rolling unit having first and second conveying apparatus for the groups, supply apparatus to supply each group with a connecting strip, and wrapping apparatus to wrap a strip about the double filter and the ends of the two cigarettes, the first conveying apparatus having spaced group supports cooperating with the input roller for successively receiving said groups from said input roller, and for advancing said groups along a first portion of a given route; the second conveying apparatus being a speed-change conveying apparatus which is substantially tangent with said first conveying apparatus, and cooperates with the group supports for successively receiving said groups from the first conveying apparatus, and feeding the groups at reduced speed along a second portion of said route, said second route portion being located in series in relation to the first route portion; the supply apparatus cooperating with the first conveying apparatus to supply each said group with the respective connecting strip as the group is displaced by said first conveying apparatus along the first route portion; and with the wrapping apparatus comprising at least one rolling bed cooperating with the second conveying apparatus to define therewith a rolling channel for the groups.

14 Claims, 6 Drawing Sheets

FILTER ASSEMBLY MACHINE

BACKGROUND OF THE INVENTION

The present invention relates to a filter assembly machine. In particular, the present invention relates to a filter assembly machine comprising a feed roller having a number of peripheral seats, each designed to receive a group consisting of two cigarette lengths separated by a double filter, and on which each said double filter is joined to the respective said cigarette lengths by means of a strip fed onto the said double filter and subsequently wrapped about the said double filter and about one end of the said cigarette lengths by rolling the respective said group about its own axis in a rolling station.

The production of increasingly high-output cigarette manufacturing machines has led to the production of increasingly fast-operating filter assembly machines, for the purpose of enabling the formation of cigarette manufacturing lines on which the output of each manufacturing machine is connected to the input of a respective filter assembly machine. Continual improvement of known filter assembly machines of the aforementioned type has enabled the attainment of extremely fast operating speeds; which speeds, however, must be considered critical in that, by mere mechanical improvement alone, they allow for no future increase in production speed, without subjecting the double cigarettes being manufactured to unacceptable strain, especially at the rolling stage. During rolling, in fact, the double cigarettes being manufactured are rolled between two facing surfaces at such a speed that, if increased over and above a given value, it would inevitably result in tobacco escaping from the open ends of the respective cigarette lengths.

SUMMARY OF THE INVENTION

The aim of the present invention is to provide a filter assembly machine, the production speed of which may be increased over and above currently attained speeds, while at the same time maintaining the speed at which the double cigarettes are rolled below a critical value at which tobacco is caused to escape from the open ends of the cigarette lengths.

With this aim in view, according to the present invention, there is provided a filter assembly machine comprising an input roller having a number of peripheral seats for respective groups, each consisting of two coaxial cigarette lengths separated by a double filter; and a rolling unit for rendering integral the said cigarette lengths and the said double filter, as they travel along a given route, by means of a strip wrapped about the said double filter and about the ends of the said cigarette lengths facing the said double filter; characterised by the fact that the said rolling unit comprises first conveying means for successively feeding the said groups along a first portion of the said route; supporting means arranged about the said first conveying means, for supporting a number of the said groups; supply means for supplying a said strip to each said group on the said first route portion; second speed-change conveying means substantially tangent with the said first conveying means and cooperating with the said supporting means, for successively receiving the said groups and feeding them at reduced speed along a second route portion located in series in relation to the said first portion; and at least one rolling bed cooperating with the said second speed-change conveying means, in such a manner as to define with the same a respective channel for rolling the said groups.

BRIEF DESCRIPTION OF THE DRAWINGS

A number of non-limiting embodiments of the preferred invention will be described by way of examples, with reference to the accompanying drawings, in which.

DETAILED DESCRIPTION OF THE INVENTION

Figure 1:
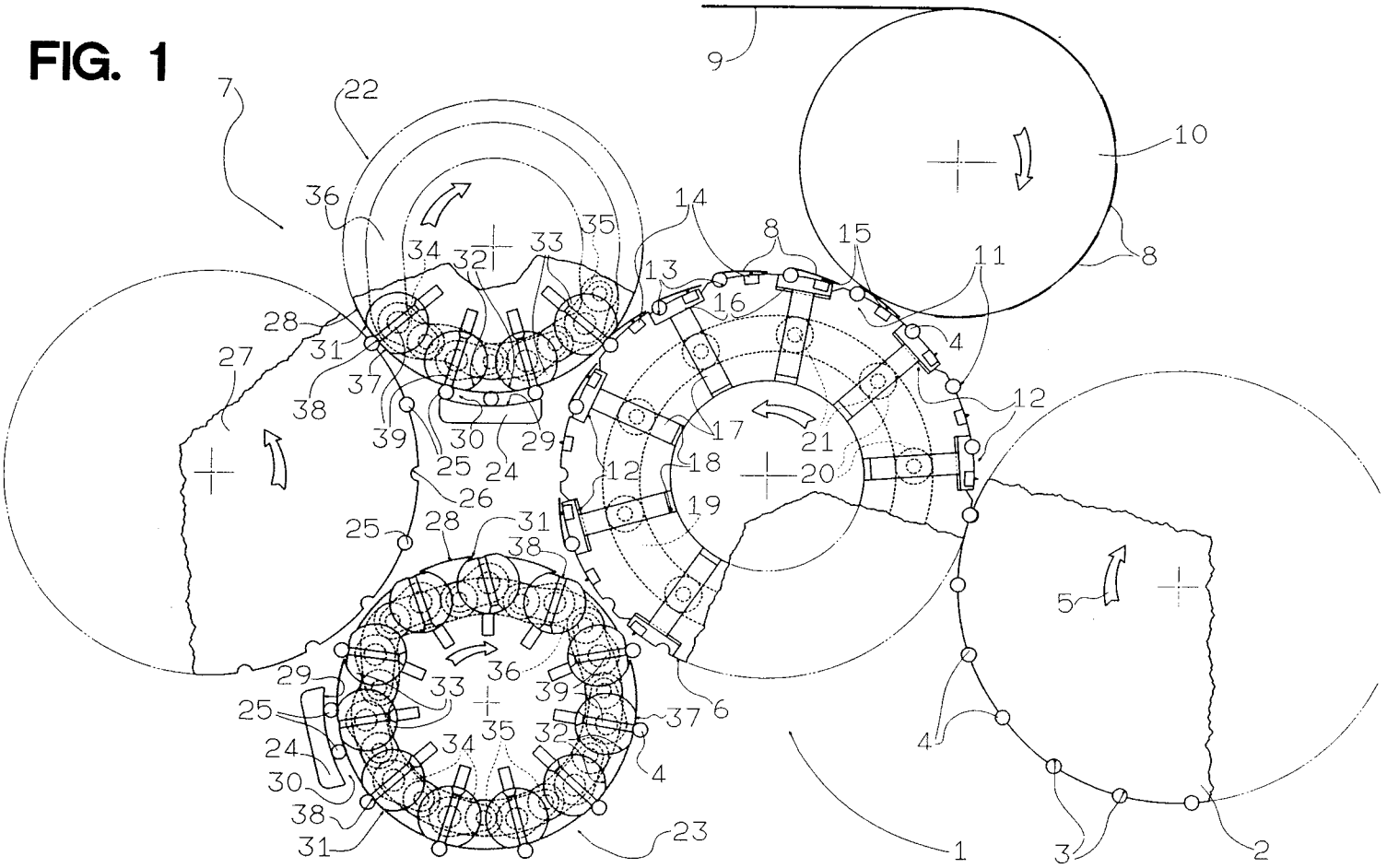
FIG. 1 shows a schematic view of a first embodiment of part of a filter assembly machine according to the present invention.

FIG. 1 shows part of a filter assembly machine indicated as a whole by 1 and and comprising an input roller 2 having a number of equally-spaced peripheral seats 3. Each seat 3 is designed to receive and retain a respective group 4 consisting (in known manner not shown) of two cigarette lengths arranged coaxial with each other and having a double filter inbetween.

By virtue of actuating means not shown, input roller 2 turns clockwise in the direction of arrow 5 in FIG. 1, and is arranged tangent with a further roller 6 which functions as an input roller for a rolling unit indicated as a whole by 7. For each group 4, rolling unit 7 is designed to connect each said cigarette length to the said double filter by wrapping a gummed strip 8, in known manner, about the said double filter and about the ends of the cigarette lengths adjacent to the same.

Strips 8 are obtained by transversely cutting a continuous strip 9 (in known manner not shown), and are fed onto roller 6 by means of a roller 10 turning clockwise in FIG. 1 and substantially tangent with a point, on the periphery of roller 6, downstream from the point of tangency between rollers 2 and 6 in the rotation direction (anti-clockwise in FIG. 1) of roller 6.

Roller 6 comprises a first number of fixed supporting elements 11, each designed to receive a group 4 and a strip 8, and spaced about the periphery of roller 6 with twice the spacing between seats 3; and a second number of mobile supporting elements 12 spaced about the periphery of roller 6 with twice the spacing between seats 3, and arranged alternately in relation to supporting elements 11.

Each of supporting elements 11 and 12 comprises a seat 13, similar to seats 3 and designed to receive and retain a respective group 4, and a block 14 located upstream from respective seat 13, in the rotation direction of roller 6, and fitted with an appendix 15 extending radially outwards from the periphery of roller 6, for maintaining an adhesive surface of a respective strip 8 detached from the surface of roller 6.

Figure 3:
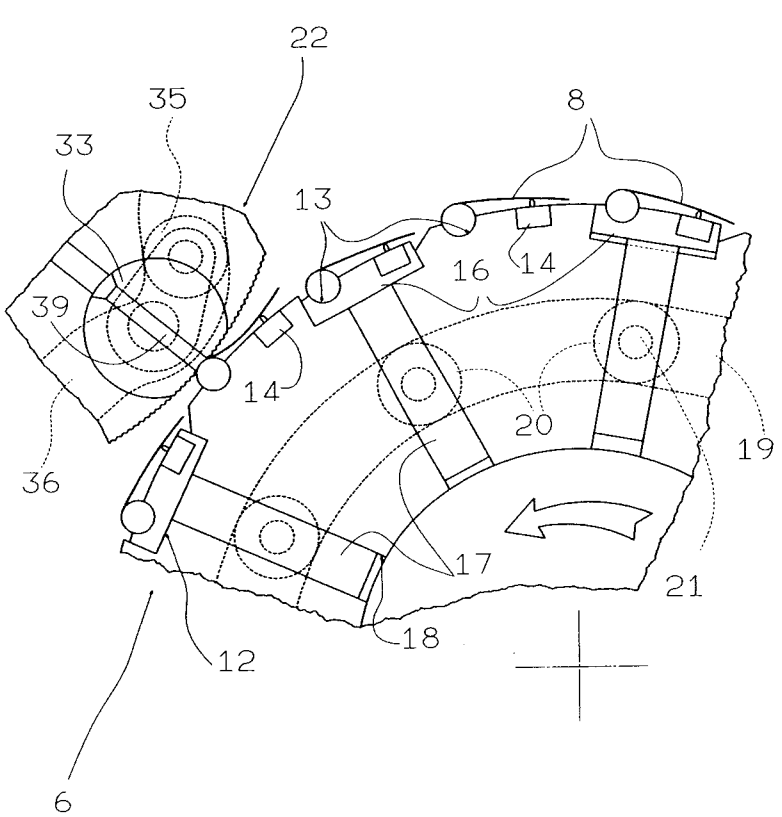
FIG. 3 shows an enlarged view of a second detail in FIG. 1.

Whereas, on supporting elements 11, seat 13 is formed directly on the periphery of roller 6 and block 14 is connected integral with roller 6, on supporting elements 12, both seat 13 and block 14 are carried on an end plate 16 of a slide 17 (also shown in FIG. 3). Each slide 17 is mounted inside a respective radial hole 18 formed on roller 6, and slides along hole 18 between an extracted position, wherein the outer surface of plate 16 is substantailly flush with the outer surface of roller 6, and a withdrawn position, wherein the outer surface of plate 16 is located inside roller 6. Such displacement of each said slide 17 between the said extracted and withdrawn positions is determined, as described in more detail later on, by means of an annular cam 19 formed on a fixed portion of roller 6 and engaged by a tappet roller 20 mounted for rotation on a respective pin 21 extending from slide 17, parallel with the axis of roller 6.

Besides rollers 6 and 10, rolling unit 7 also comprises a further two rollers 22 and 23 substantially identical and arranged tangent with respective points, on the periphery of roller 6, downstream from the point of tangency between rollers 6 and 10 in the rotation direction of roller 6. Each of rollers 22 and 23, of which only roller 22 will be described hereinafter, removes respective groups 4 off roller 6 and feeds them along a respective route located in series in relation to the common route travelled by all of groups 4 about roller 6. The functions performed by each of rollers 22 and 23 are to reduce the travelling speed of respective groups 4 according to a given reduction ratio in relation to the travelling speed of groups 4 about roller 6; roll, in known manner but at reduced speed, respective groups 4 on a respective rolling bed 24, in such a manner as to wrap and stick strips 8 about the said groups 4 and so form as many double cigarettes 25; accelerate the speed of the said double cigarettes 25 so as to bring it back up to the original speed of respective groups 4; and transfer the said double cigarettes 25 to respective seats 26 formed on the periphery of an output roller 27 tangent with both rollers 22 and 23.

As shown in FIG. 1, roller 22 only removes from roller 6 the groups 4 on fixed supporting elements 11, whereas roller 23 only removes from roller 6 the groups 4 on mobile supporting elements 12. This is achieved by designing cam 19 in such a manner as to cause each slide 17 to move into the withdrawn position, as it passes through the point of tangency between rollers 6 and 22, and to move back into the extracted position, as it passes through the point of tangency with roller 23.

Roller 22 presents a knurled cylindrical outer surface 28, a portion of which is located facing a surface 29 of rolling bed 24; which surface 29 is located facing surface 28 and extends along a cylinder coaxial with the same; the said surface 28 defining, together with surface 29, a rolling channel 30 slightly narrower than the diameter of groups 4.

The knurled surface 28 of roller 22 is broken by a number of openings 31 extending axially along and equally spaced about surface 28. Each opening 31 provides for lateral external communication of a respective cylindrical slot 32 having its axis parallel with that of roller 22. Inside each slot 32, there is housed, in rotary manner, a cylindrical body 33 fitted with a transverse lever 34 projecting laterally from the respective said cylindrical body 33 and connected, in rotary manner on its free end, to a tappet roller 35 cooperating with an annular cam 36 formed on a fixed porton of roller 22.

As shown, particularly in FIGS. 1 and 2, each cylindrical body 33 presents a lateral, externally-knurled, faced portion 37, and is mounted in such a manner that the distance between its axis and the said surface 28 is less than the radius of cylindrical body 33, and in such a manner that by setting cylindrical body 33 in a given angular position, hereinafter referred to as the "rolling position", in relation to roller 22, the said knurled faced portion 37 is arranged flush with the said knurled surface 28, thus providing for a continuous knurled surface 28 over the respective said opening 31.

Figure 2:
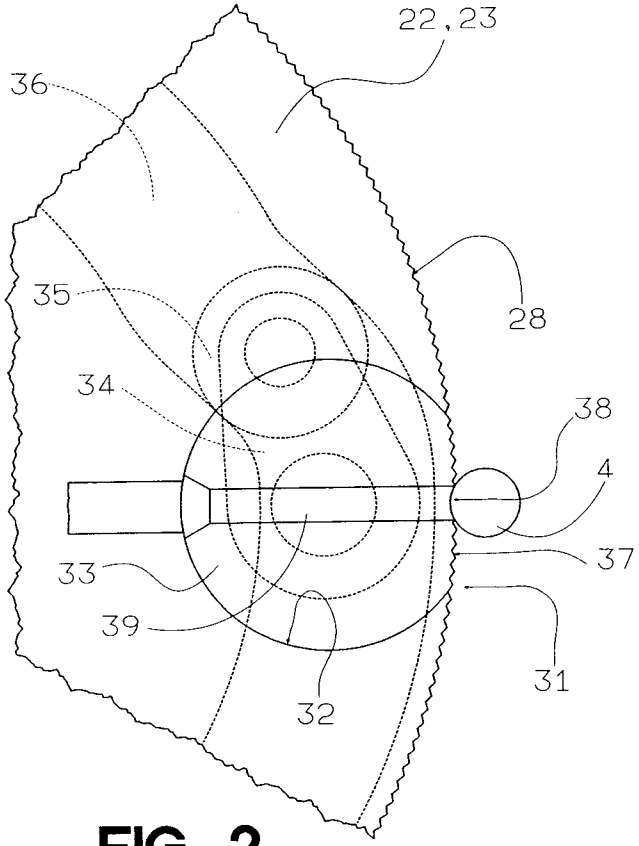
FIG. 2 shows an enlarged view of a first detail in FIG. 1.

Each faced portion 37 presents a centre seat 38 designed to receive and retain a respective group 4 by means of suction along a diametrical suction channel 39 (also shown in FIG. 2).

In actual operation, rollers 22 and 23 turn clockwise about their respective axes at a relatively low surface speed, at any rate, lower than that of rollers 6 and 27 which turn at the same surface speed. Groups 4 initially housed inside seats 3 on input roller 2 are transferred in known manner (not shown) into seats 13 on roller 6, the surface speed of which is the same as that of roller 2.

As it passes through the tangent point between rollers 6 and 10, each group 4 housed inside a seat 13 receives a strip 8, which is first arranged with its downstream end resting on the outer periphery of respective group 4, and its upstream end resting on the free end of respective appendix 15.

As they pass through the tangent line between rollers 6 ans 22, slides 17 move into the withdrawn position, as already described, to prevent groups 4 on the said slides from interfering with roller 22. Prior to reaching the tangent line between rollers 6 and 23, however, slides 17 move back into the extracted position, for enabling respective groups 4 to be transferred to the said roller 23. In other words, groups 4 on fixed supporting elements 11 are transferred to roller 22, while groups 4 on supporting elements 12 are transferred to roller 23.

As the method of transferring groups 4 is the same for both rollers 22 and 23, the following description will deal solely with the transfer of groups 4 on fixed supporting elements 11 from roller 6 to roller 22.

In the example shown, the surface speed of roller 22 is approximately a third less than that of roller 6.

Annular cam 36 is designed in such a manner that, as a group 4 on a fixed supporting element 11 approaches the tangent line between rollers 6 and 22, cylindrical body 33 located immediately upstream from the said tangent line is turned in conformance with roller 22 and at such a speed that the total surface speed of seat 38, over a given route portion astride the said tangent line, equals the surface speed of roller 6, thus enabling transfer of group 4 from respective seat 13 to respective seat 38. The design of cam 36 and the position of cylindrical body 33 are such that, during transfer of group 4 from roller 6 to roller 22, cylindrical body 33 is maintained in a position close to the said rolling position, and with its seat 38 substantially facing respective seat 13.

Subsequent to transfer, cam 36 locks oscillating cylindrical body 33 in the rolling position, in such a manner that group 4, upon entering rolling channel 30, is released from respective seat 38, by virtue of friction on surface 29 of rolling bed 24, and rolls along the continuous cylindrical knurled surface consisting of surface 28 and faced portion 37 flush with the same, so as to wrap around gummed strip 8.

Groups 4 are thus rolled along rolling channel 30 at relatively low speed, in that the travelling speed of groups 4 along rolling channel 30 is substantially equal to half the surface speed of roller 22, which equals only a fraction of the surface speed of rollers 6 and 27.

As it travels through channel 30, each group 4 rolls over surface 28 backwards in relation to its original seat 38, so as to engage the next upcoming seat 38.

By the time it reaches the output of channel 30, the original group 4 has been transformed into a double cigarette 25, the cylindrical body 33 of which is turned, by cam 36, first anticlockwise and then clockwise to conform with the rotation direction of roller 22 and so bring the travelling speed of the said double cigarette 25 up to the surface speed of roller 27 as respective seat 38 travels over a route portion astride the tangent line between rollers 22 and 27, thus enabling transfer of double cigarette 25 from respective seat 38 to respective seat 26 on roller 27.

The double cigarettes 25 fed onto roller 27 from roller 23 occupy alternate seats 26, the remaining empty seats 26 being subsequently occupied by double cigarettes 25 fed onto roller 27 from roller 22.

Figure 4:
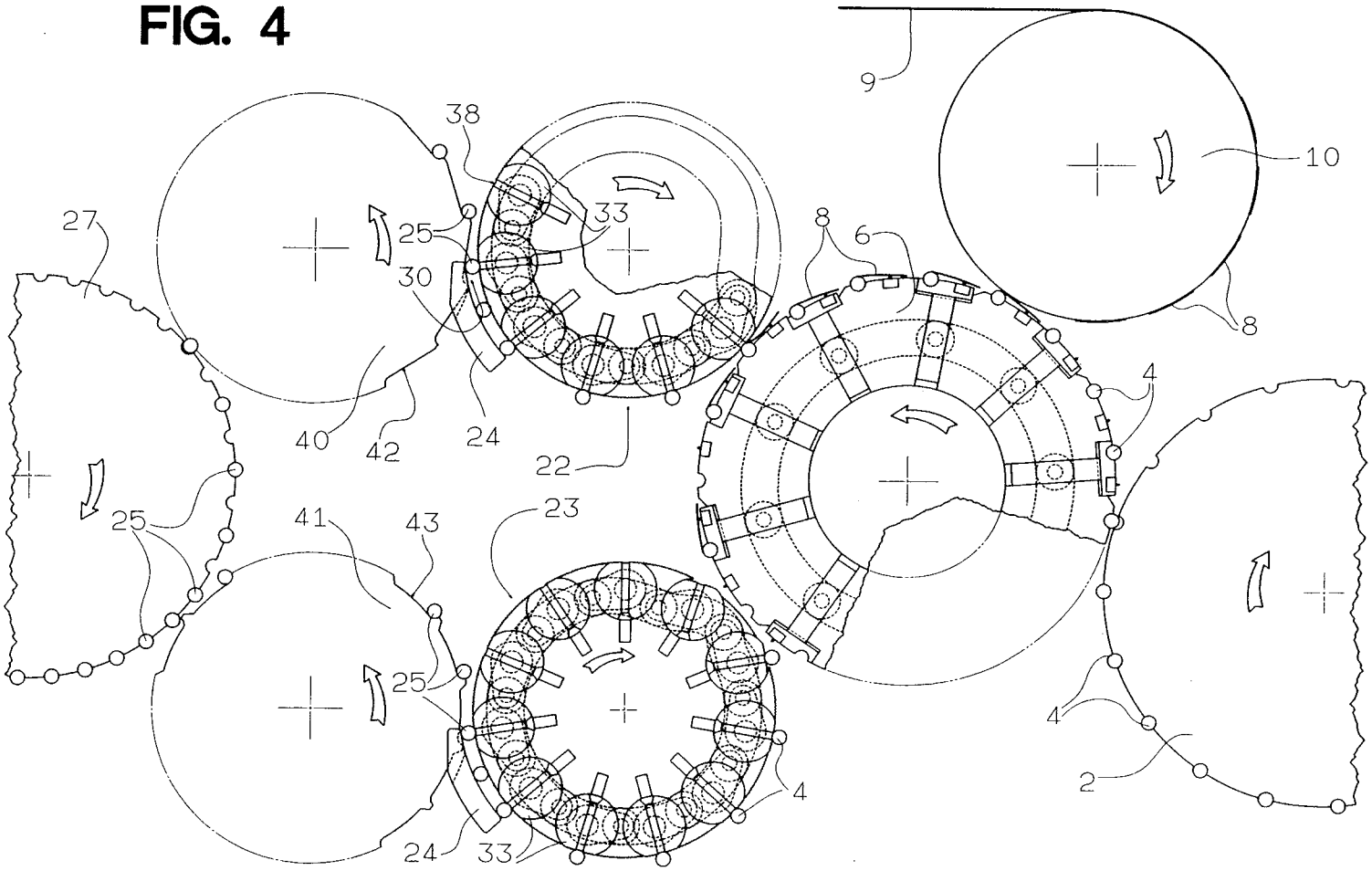
FIG. 4 shows a schematic view of a second embodiment of the filter assembly machine according to the present invention.

In the embodiment shown in FIG. 4, the speed of double cigarettes 25 leaving rolling channels 30 is no longer increased by oscillating respective cylindrical bodies 33 in such a manner as to equal the travelling speed of seats 26, but using two known timing rollers 40 and 41 inserted respectively between roller 27 and rollers 22 and 23, and tangent with the said rollers 22 and 23 along lines substantially located at the output of respective rolling channels 30.

Roller 40 presents substantially serrated outer teeth, and defines, about its outer periphery, a number of elongated, substantially triangular seats 42 having an inclined bottom surface.

Roller 40 turns anticlockwise, as shown in FIG. 4, at the same surface speed as rollers 6 and 27. Upon approaching the downstream end of rolling channel 30, double cigarettes 25 engage, in rolling manner, a respective seat 42 and move backwards, in relation to the periphery of roller 40, up to the upstream end of the same, where they are removed in known manner from respective seat 38 at a speed equal to the surface speed of roller 40 and, consequently also, of roller 27.

Like roller 40, roller 41 also presents a number of elongated seats 43 having the same function as seats 42, the only difference between seats 42 and 43 being that seats 43 present a cylindrical bottom surface enabling the transfer of double cigarettes 25 already transferred from roller 40 to roller 27. As already stated in connection with the embodiment shown in FIGS. 1 to 3, the relationship between the surface speeds of rollers 22 and 23 and roller 6 depends on the design of respective cam 36. As such, the rolling speed of groups 4 along each rolling channel 30 may be lowered as required, by appropriately modifying the profile of cam 36, which obviously provides for simplifying the embodiments shown in FIGS. 1 to 3 and FIG. 4.

Figure 5:
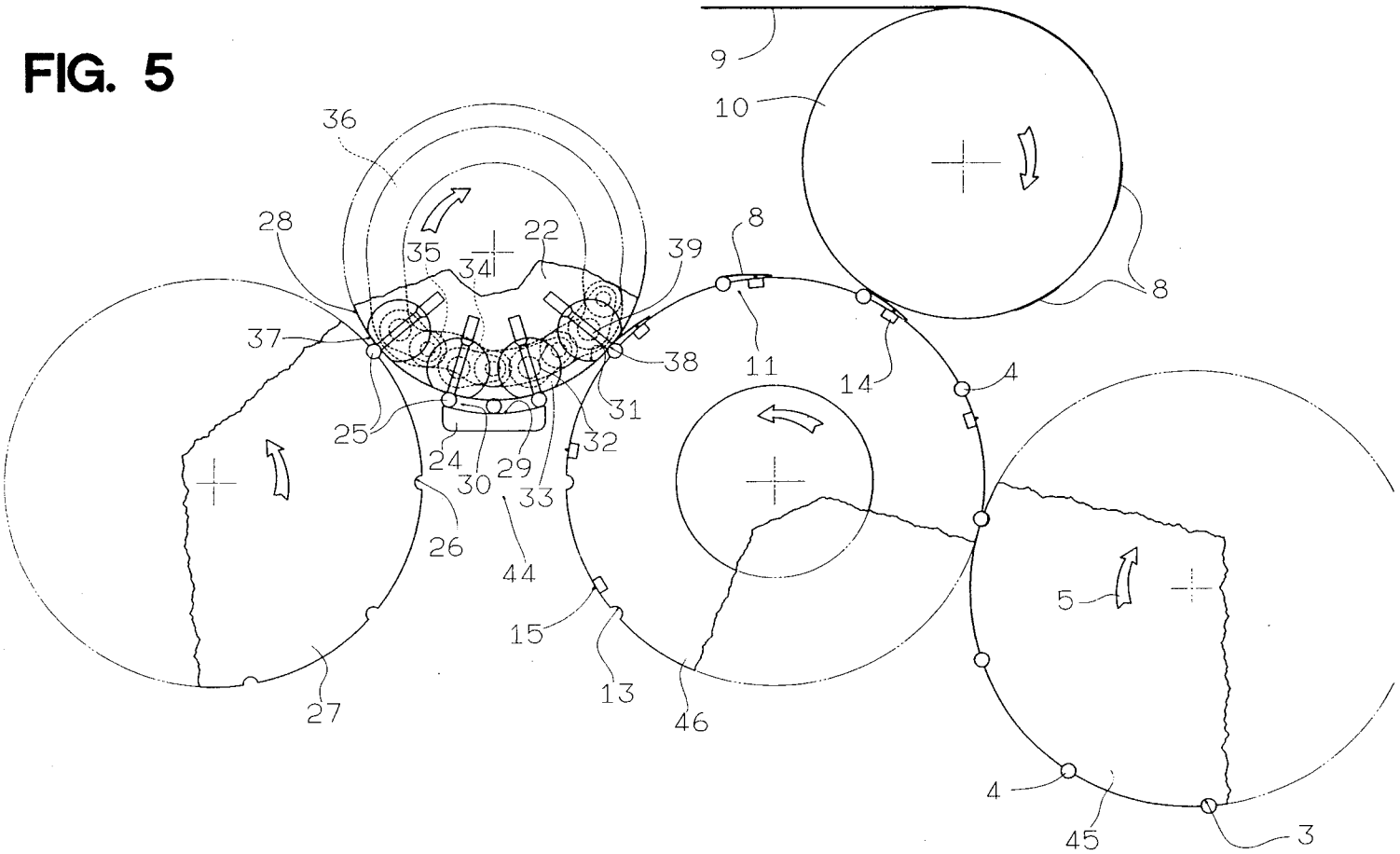
FIG. 5 shows a schematic view of a variation of the FIG. 1 embodiment.

FIG. 5, for example, shows a simplified variation of the embodiment shown in FIGS. 1 to 3. The FIG. 5 variation relates to a rolling unit 44 identical to rolling unit 7 in FIG. 1, except for the fact that it is supplied by a roller 45 having peripheral seats 3 with twice the spacing of seats 3 on roller 2, and that it comprises an input roller 46 which, unlike input roller 6 on rolling unit 7, only comprises fixed supports 11 and has no mobile supports 12. Consequently, as roller 23 on rolling unit 7 may thus be dispensed with, rolling unit 44 comprises only roller 22.

It follows, therefore, that, for a given output on filter assembly machine 1, rollers 45 and 46 on unit 44 must turn twice as fast as corresponding rollers 2 and 6, whereas the surface speeds of respective rollers 22 may be maintained substantially the same by appropriately modifying the profile of cam 36 on roller 22 of unit 44. For the sake of simplicity, cam 36 in FIG. 5 presents substantially the same form as cam 36 in FIGS. 1 and 2. As any technician skilled in the art will be fully aware, however, the sharper the variation is in the profile of cam 36, the greater will be the angular acceleration imparted on cylindrical bodies 33.

Figure 6:
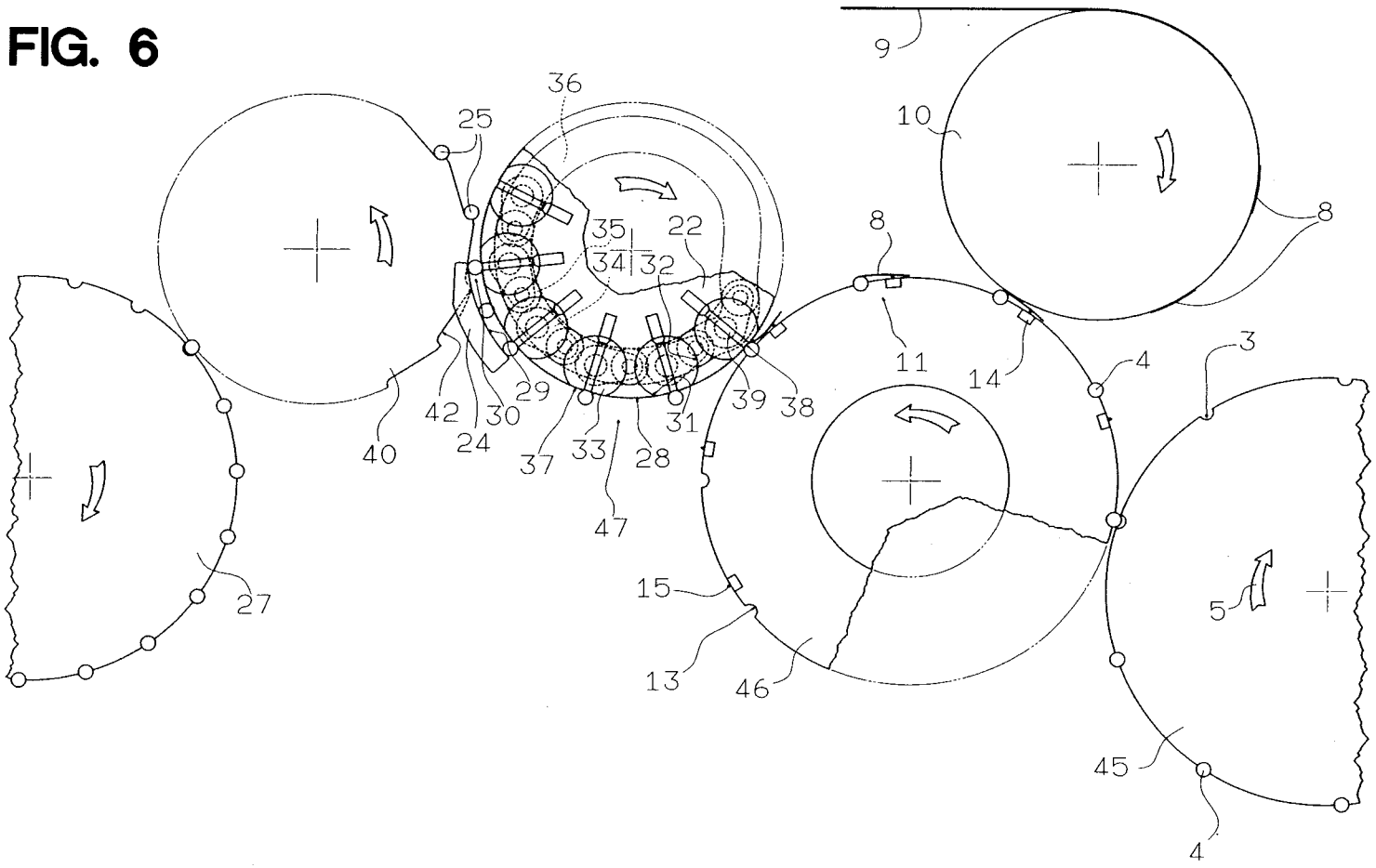
FIG. 6 shows a schematic view of a variation of the FIG. 4 embodiment.

A simplified version similar to that of FIG. 5 is shown in FIG. 6, which shows a variation of the FIG. 4 embodiment. The FIG. 6 variation shows a rolling unit 47 identical to the FIG. 4 rolling unit, except for the fact that it employs a supply roller 45 and an input roller 46, as already described, and has no roller 23 or respective timing roller 41.

On unit 47 also, the profile of cam 36 is modified for increasing angular acceleration of cylindrical bodies 33. The FIG. 7 embodiment is similar to the FIG. 5 variation, except for the fact that it comprises a rolling unit 48 having a different speed-change roller 49 in place of roller 22.

Roller 49 comprises a powered rotary disc 50 located facing a coaxial fixed disc (not shown) and on the front surface of which there is formed an annular cam 51 travelled along by a number of tappet rollers 52. The axis of each roller 52 is integral with a respective annular sector 53 supported on disc 50, each section 53 is designed to move, together with disc 50, about the axis of the same, as well as radially in relation to disc 50, by virtue of the design of cam 51, between a withdrawn or "rolling" position, wherein the radius of cylindrical outer surface 54 on sector 53 equals the distance between surface 54 and the rotation axis of roller 49, and an extracted position.

Sectors 53 all present the same circumferential length, which may be calculated by dividing by the number of sectors 53 the surface of a cylinder having a radius equal to the distance between the axis of roller 49 and the outer surface 54 of a sector 53 in the rolling position. It follows, therefore, that, when two adjacent sectors 53 are set to the said rolling position, with their respective adjacent ends contacting, outer surface 54, which are preferably knurled, define a single continuous cylindrical surface portion 55 twice as long as each of surfaces 54.

At the tail end of surface 54, in the rotation direction of roller 49, each sector 53 presents a seat 56 designed to receive a respective group 4.

In actual operation, each sector 53 travels through the tangency point with roller 46 in the said extracted position, in such a manner as to receive a group 4 and a respective strip 8 inside seat 56. As it is turned by roller 49 towards rolling bed 24, each sector 53 is moved radially inwards, by cam 51, into the said withdrawn position, which is reached when the front end of sector 53 reaches rolling bed 24. In this position, the front end of sector 53 contacts the rear end of the foregoing sector 53, so as to define surface 55 which, together with the inner surface of rolling bed 24, defines rolling channel 30.

Further rotation of roller 49 causes group 4 carried on the said sector 53 to enter rolling channel 30 and to cooperate with bed 24 in such a manner as to be rolled by friction between surface 54 of respective sector 53 and bed 24, and along surface 54 so as to wrap around strip 8. Rolling is terminated when group 4 reaches seat 56 on the next sector 53.

Once the rolling operation has been terminated, each sector 53 is gradually restored to the said extracted position, prior to reaching the tangency point with output roller 27 to which it releases a formed double cigarette 25.

Figure 7:
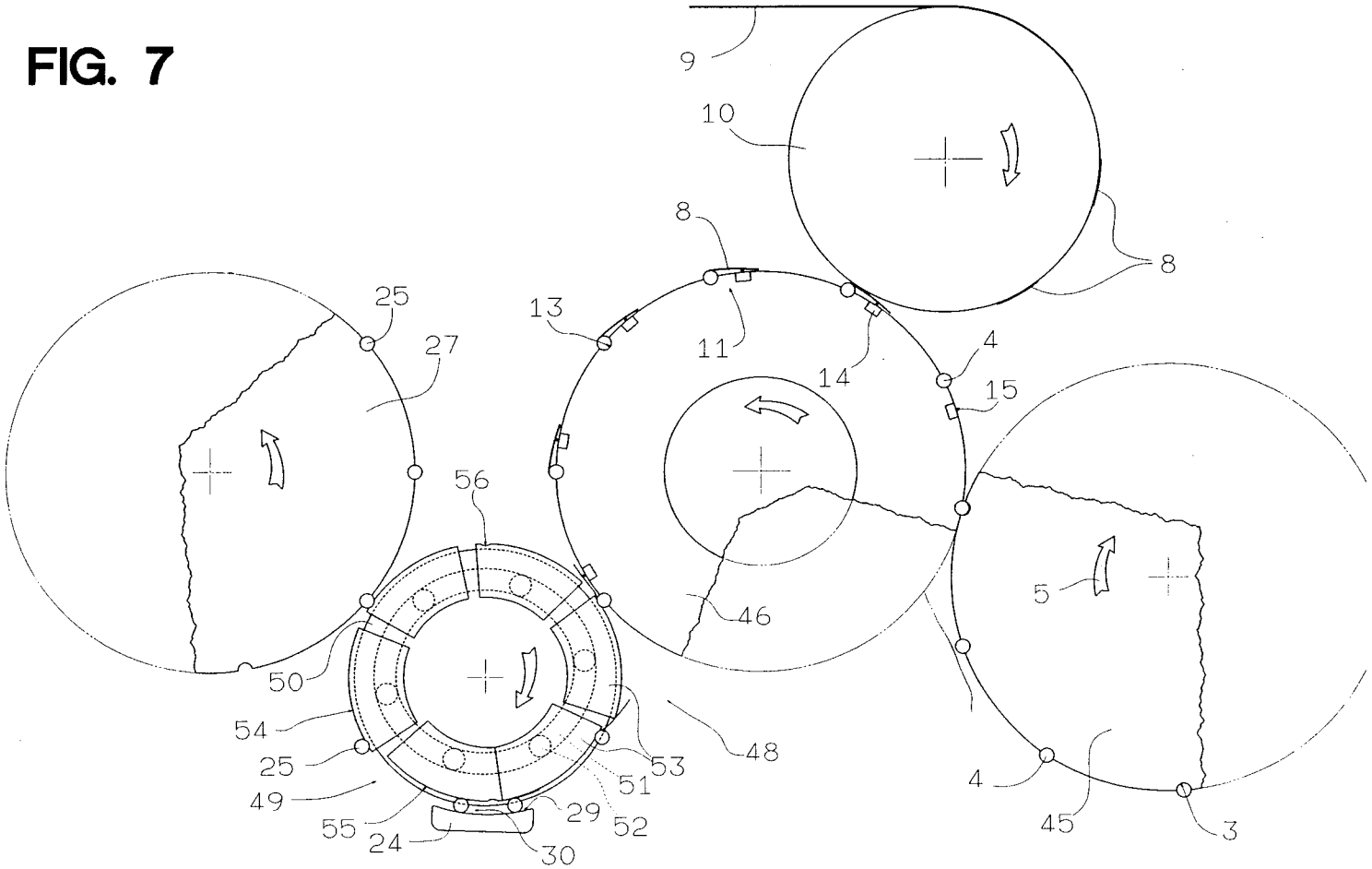
FIG. 7 shows a schematic view of a further embodiment of the filter assembly machine according to the present invention.

As in the previous embodiments, speed-change roller 49 in the FIG. 7 embodiment provides for temporarily reducing the travelling speed of groups 4 as they pass through rolling channel 30, thus enabling relatively low-speed rolling, and preventing tearing of the cigarette lengths being processed.

What is claimed is:

1. A filter assembly machine (1) comprising an input roller (2)(45) having a number of spaced peripheral seats (3) for respective cigarette groups (4), each group comprising two coaxial cigarette lengths and a double filter arranged therebetween; and a rolling unit (7)(44)(47)(48) for said groups; said rolling unit comprising first (6) and second conveying means (22,23)(22,40)(23,41)(49) for said groups, supply means (10) to supply each said group with a connecting strip (8), and wrapping means to wrap each said strip about the respective double filter and the ends of the two cigarette lengths facing said double filter; said first conveying means having spaced group support means (11,12) cooperating with said input roller for successively receiving said groups from said input roller, and for advancing said groups along a first portion of a given route; said second conveying means being a speed-change conveying means which are substantially tangent with said first conveying means, and cooperate with said group support means for successively receiving said groups from said first conveying means, and feeding said groups at reduced speed along a second portion of said route, said second route portion being located in series in relation to said first route portion; said supply means cooperating with said first conveying means to supply each said group with the respective connecting strip as said group is displaced by said first conveying means along said first route portion; and said wrapping means comprising at least one rolling bed (24) cooperating with said second conveying means to define therewith a rolling channel (30) for said groups.

2. A machine according to claim 1 wherein the said first conveying means (6) comprise a cylindrical rotary conveyor roller, and that the said second conveying means (22,23) comprise at least one cylindrical rotary speed-change roller substantially tangent with the said conveyor roller (6).

3. A machine according to claim 2 wherein each said group support means (11,12) comprises a seat (13) designed to receive a respective said group (4) and arranged transversely in relation to the rotation direction of the said conveyor roller (6), and an appendix (15) located on the said conveyor roller (6) downstream from the respective said seat and extending outwards for supporting one end of a respective said strip (8).

4. A machine according to claim 3 wherein each said group support means (11,12) comprises a fixed group support element arranged on the periphery of said conveyor roller.

5. A machine according to claim 3 wherein said group support means comprise first and second support elements arranged alternately about said conveyor roller for supporting a first and a second number of said groups respectively; each said support element comprising a respective said seat and a respective said appendix; said second conveying means comprising a first and a second speed-change roller substantially tangent with said conveyor roller and cooperating with said first and said second support elements respectively; said first and said second support elements being fixed and mobile respectively in relation to a cylindrical outer surface of said conveyor roller, drive means being carried by said conveyor roller to move said second support elements in relation to said cylindrical surface between an extracted position, wherein said second support elements are flush with said cylindrical surface, and a withdrawn position, wherein said second support elements are set back in relation to said cylindrical surface.

6. A machine according to claim 5 wherein said drive means comprise, for each said second support element, a slide mounted on said conveyor roller for radial movement therethrough and supporting the respective second support element, and actuating means connected to said slide for selectively setting the respective said second support element in said withdrawn and extracted position as said support element faces said first and said second speed-change roller respectively.

7. A machine according to claim 2 wherein each said speed-change roller has an outer surface comprising a number of cylindrical axial portions substantially equally spaced about the axis of rotation of said speed-change roller and mobile in relation thereto; said speed-change roller comprising a number of mobile members each defining a respective said mobile surface portion, actuating means cooperating with said mobile members to move each said mobile surface portion between a pick-up position assumed at the point of tangency with said first conveying means, and a rolling position assumed at the respective said rolling channel, and a seat for a respective said group formed axially on each said mobile surface portion.

8. A machine according to claim 7 wherein each said mobile member is mounted on said speed-change roller for rotation in relation thereto about a respective axis parallel with the axis of rotation of the speed-change roller to displace the respective said mobile surface portion between said pick-up and rolling positions.

9. A machine according to claim 8 wherein a number of cylindrical axial slots are provided through a peripheral portion of said speed-change roller, and an equal number of lateral axial openings, each communicating with a respective said slot, are provided through said cylindrical surface of said speed-change roller; each said mobile member comprising a cylindrical body mounted in a rotary manner within a respective said slot and having a lateral faced portion constituting a respective said mobile surface portion.

10. A machine according to claim 7 wherein said cylindrical surface is a knurled surface.

11. A machine according to claim 7 wherein each said mobile member is shaped as a cylindrical sector mounted on said speed-change roller for radial movement in relation thereto to displace the respective said mobile surface portion between said pick-up and rolling positions.

12. A machine according to claim 11 wherein each said mobile portion has a peripheral length equal to the peripheral length of a cylinder defined by all said sectors in their rolling position divided by the number of said sectors.

13. A machine according to claim 1 wherein said rolling unit further comprises output conveying means for said groups; said output means being tangent to said second conveying means downstream from said rolling bed.

14. A machine according to claim 1 wherein said rolling unit further comprises output conveying means for said groups, and further speed-change conveying means located between said second conveying means and said output conveying means to receive said groups from said second conveying means and to feed them at increased speed to said output conveying means.

* * * * *